US006718144B2

(12) United States Patent
Hiroshima et al.

(10) Patent No.: US 6,718,144 B2
(45) **Date of Patent: *Apr. 6, 2004**

(54) IMAGE FORMING APPARATUS AND PROCESS UNIT MOUNTABLE TO IMAGE FORMING APPARATUS

(75) Inventors: Koichi Hiroshima, Shizuoka-ken (JP); Masahide Kinoshita, Shizuoka-ken (JP); Hironobu Isobe, Shizuoka-ken (JP); Ryuichi Yoshizawa, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/293,318

(22) Filed: Nov. 14, 2002

(65) Prior Publication Data

US 2003/0091353 A1 May 15, 2003

Related U.S. Application Data

(62) Division of application No. 09/575,988, filed on May 23, 2000.

(30) Foreign Application Priority Data

May 24, 1999 (JP) ..... 11-143269

(51) Int. Cl.[7] ..... G03G 15/00; G03G 15/08; G03G 21/18

(52) U.S. Cl. ..... 399/12; 399/25; 399/26; 399/27

(58) Field of Search ..... 399/12, 24, 25, 399/26, 27, 111, 113, 117

(56) References Cited

U.S. PATENT DOCUMENTS

| | | | | |
|---|---|---|---|---|
| 4,751,484 A | | 6/1988 | Matsumoto et al. | 355/14 |
| 5,014,094 A | | 5/1991 | Amitani et al. | |
| 5,095,335 A | | 3/1992 | Watanabe et al. | 355/210 |
| 5,331,373 A | | 7/1994 | Nomura et al. | 355/200 |
| 5,452,056 A | | 9/1995 | Nomura et al. | 355/200 |
| 5,548,374 A | | 8/1996 | Iguchi et al. | 399/24 |
| 5,572,292 A | * | 11/1996 | Chatani et al. | 399/25 |
| 5,585,889 A | | 12/1996 | Shishido et al. | 355/200 |
| 5,589,918 A | | 12/1996 | Oshida et al. | 399/114 |
| 5,678,125 A | | 10/1997 | Kutsuwada et al. | 399/26 |
| 5,682,574 A | | 10/1997 | Oshida et al. | 399/64 |
| 5,708,912 A | | 1/1998 | Lee | |
| 5,778,279 A | | 7/1998 | Kawai et al. | |
| 5,802,419 A | | 9/1998 | Sakurai et al. | |
| 5,995,774 A | | 11/1999 | Applegate et al. | 399/27 |
| 6,064,843 A | | 5/2000 | Isobe et al. | 399/111 |

FOREIGN PATENT DOCUMENTS

| | | | |
|---|---|---|---|
| EP | 0 532 308 | | 3/1993 |
| EP | 0 913 745 | | 5/1999 |
| JP | 62-212677 | | 9/1987 |
| JP | 62-255959 | | 11/1987 |
| JP | 1-77044 | | 7/1989 |
| JP | 8-211792 A | * | 8/1996 |
| JP | 10-221938 | * | 8/1998 |
| JP | 10-268621 | | 10/1998 |
| JP | 10-274908 | | 10/1998 |

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes an image bearing member; a developing device for developing a latent image formed on the image bearing member, the image bearing member and the developing means being detachably mountable to the apparatus as a process unit; a developer supply unit for supplying a developer to the developing means, the developer supply unit being detachably mountable to the apparatus; and a first memory mounted on the process unit. The first memory stores information relating to the developer supply unit.

25 Claims, 6 Drawing Sheets

IMAGE FORMING APPARATUS AND PROCESS UNIT MOUNTABLE TO IMAGE FORMING APPARATUS

CROSS REFERENCE TO RELATED APPLICATION

This application is a divisional of U.S. patent application Ser. No. 09/575,988, filed May 23, 2000.

FIELD OF THE INVENTION AND RELATED ART

The present invention relates to an image forming apparatus using an electrophotographic type process and a process cartridge and a developer supply unit detachably mountable to an image forming apparatus.

Here, the electrophotographic image forming apparatus forms an image on a recording material through an electrophotographic image-formation-type process. Examples of electrophotographic image forming apparatus include an electrophotographic copying machine, an electrophotographic printer (laser beam printer, LED printer or the like), a facsimile machine and a word processor.

The above-described process cartridge contains as a unit an electrophotographic photosensitive member and a charging means, a developing means or a cleaning means in the form of a cartridge that is detachably mountable to a main assembly of an image forming apparatus. The process cartridge may contain an electrophotographic photosensitive member and at least one of a charging means, a developing means and a cleaning means in the form of a cartridge, which is detachably mountably to a main assembly of an image forming apparatus. The process cartridge may contain an electrophotographic photosensitive member and at least developing means in the form of a cartridge that is detachably mountable to a main assembly of an image forming apparatus.

With a process-cartridge-type apparatus, the servicing or maintenance operations can be in effect carried out by the users, so that the operability is significantly improved, and therefore, the process cartridge type is widely used in the electrophotographic field.

Recently, a toner-supply type, process-cartridge-type apparatus has been proposed with which the advantages of the process cartridge and the advantages of the toner-supply-type apparatus can be both enjoyed.

In such a system, the process cartridge comprises at least a photosensitive drum (electrophotographic photosensitive member), charging means for electrically charging the photosensitive drum, developing means for visualizing an electrostatic latent image formed on the photosensitive drum with toner, and a developer supply unit for metering the toner to the developing means (toner supply unit).

With the use of such a toner-supply-type process cartridge with the electrophotographic image forming apparatus, the maintenance and usability are improved, and the running cost can be reduced.

However, the toner-supply-type, process-cartridge, type apparatus in which the process cartridge and the toner supply unit are separable from each other involves the following problems.

The service life of the process cartridge, which is integral with a toner bottle containing the supply toner, can be easily detected since the amount of the toner filled therein is known. However, in the system wherein the toner bottle of the toner supply unit is separable from the process cartridge, an additional means for detecting the service life is required.

Usually, the service lives of the process cartridge and toner supply unit detachably mountable to the main assembly are different, as follows:

Developer supply unit lifetime $\leqq$ process cartridge lifetime

In other words, a plurality of developer supply units are used with one process cartridge, in most cases.

Therefore, it is necessary to detect the service lives of the developer supply unit and the process cartridge.

SUMMARY OF THE INVENTION

Accordingly, it is a principal object of the present invention to provide an image forming apparatus in which the end of the service life of a process unit detachably mountable to the image forming apparatus can be correctly detected.

It is another object of the present invention to provide an image forming apparatus in which information relating to the apparatus can be given to the user.

It is a further object of the present invention to provide an image forming apparatus, comprising, an image bearing member;

developing means for developing a latent image formed on the image bearing member, the image bearing member and the developing means being detachably mountable to the apparatus as a process unit;

a developer supply unit for supplying a developer to the developing means, the developer supply unit being detachably mountable to the apparatus; and a first memory mounted on the process unit, wherein the first memory stores information relating to the developer supply unit.

It is a further object of the present invention to provide a process unit detachably mountable to an image forming apparatus, comprising:

an image bearing member;

a developing means for developing a latent image formed on the image bearing member; and a memory for storing information, wherein the memory is detachably mountable to the apparatus and stores information relating to a developer supply unit for supplying developer to the developing means.

These and other objects, features and advantages of the present invention will become more apparent upon a consideration of the following invention taken in conjunction with the accompanying drawings.

DESCRIPTION OF THE PREFERRED EMBODIMENTS

Embodiment 1

Figure 2:
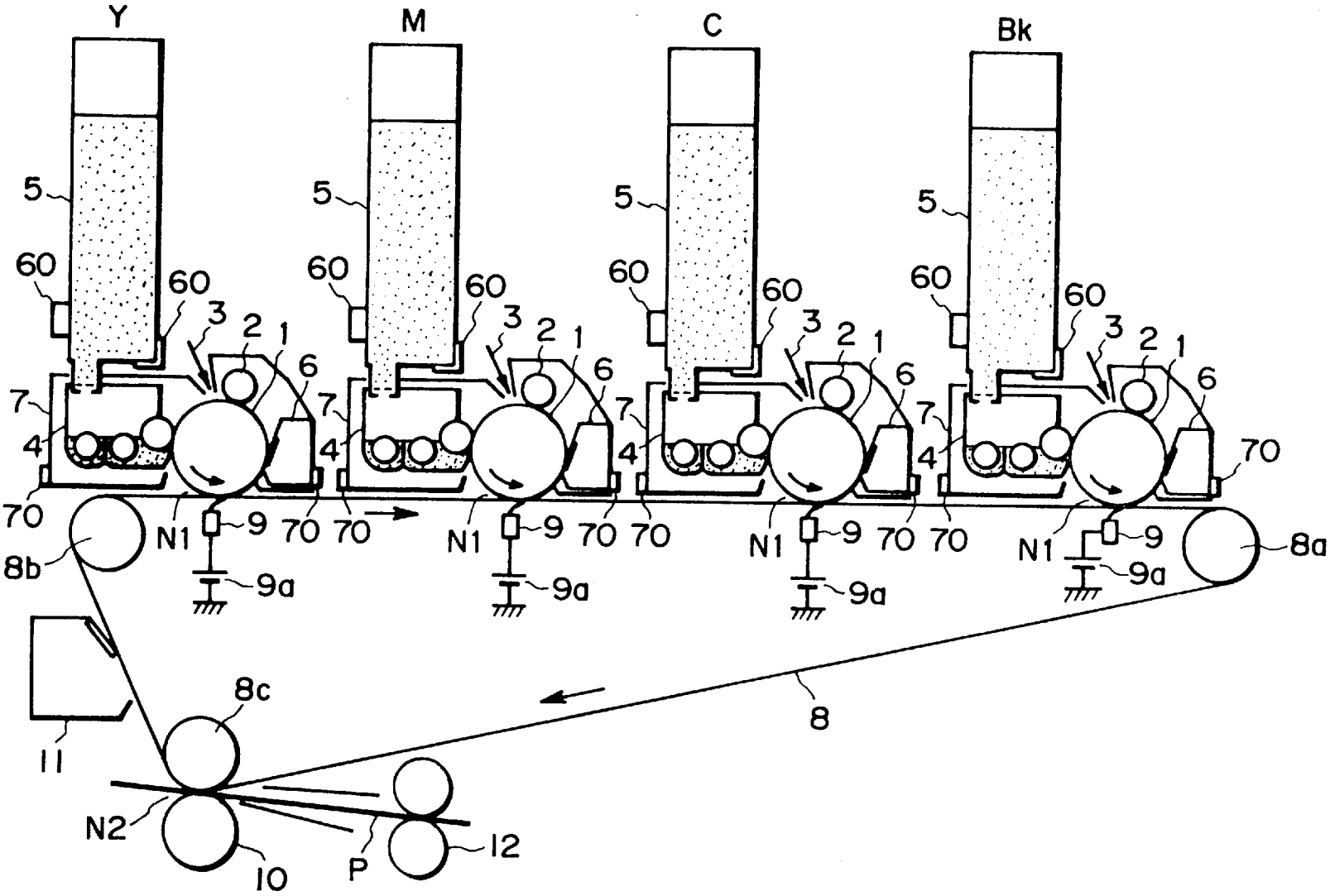
FIG. 2 is an illustration of a color laser beam printer according to the first to third embodiments of the present invention.

Referring to FIG. 2, a description will be provided as to a color laser beam printer using an electrophotographic process, which is an electrophotographic image forming apparatus according to a first embodiment of the present invention.

A color laser beam printer shown in FIG. 2 is a four-drum type (in-line) printer which is loaded with four process cartridges 7. An image is formed on a first image bearing member in the form of an electrophotographic photosensitive member (photosensitive drum) 1 of each process cartridges 7 and the image is temporarily transferred onto a second image bearing member in the form of an intermediary transfer belt 8. The images on the plurality of process cartridges are continuously and superposedly transferred onto the intermediary transfer belt 8 so as to provide a full-color printed image.

In FIG. 2, the endless intermediary transfer belt 8 is stretched around a driving roller 8*a*, a tension roller 8*b* and a back-up roller 8*c* for secondary transfer, and is rotated in the direction indicated by the arrow.

Four process cartridges (process cartridge) 7 are disposed in a line along a horizontal surface of the intermediary transfer belt 8 in the order of yellow Y, magenta M, cyan C and black Bk cartridges.

A description will be provided as to the process cartridge 7. All of the process cartridges 7 are substantially the same except for the color, and therefore, the same reference numerals are assigned to the elements having the corresponding functions, and the detailed description thereof is omitted for simplicity.

The photosensitive drum 1 disposed in the process cartridge 7 for developing the image with yellow toner, disposed most upstream with respect to a moving direction of the intermediary transfer belt 8 is uniformly charged to a predetermined potential and polarity by a primary charging roller 2 during the rotation of the photosensitive drum 1. The photosensitive drum 1 is exposed to image exposure 3 which is provided by, for example, a scanning exposure optical system (laser scanning) outputting a laser beam modulated in accordance with a time series electrical digital pixel signal corresponding to image information provided by color-separating a color original image. By the exposure, an electrostatic latent image is formed for a first color component (yellow component).

The electrostatic latent image is developed with yellow toner (first color) by a first developing device (yellow developing device).

Figure 1:
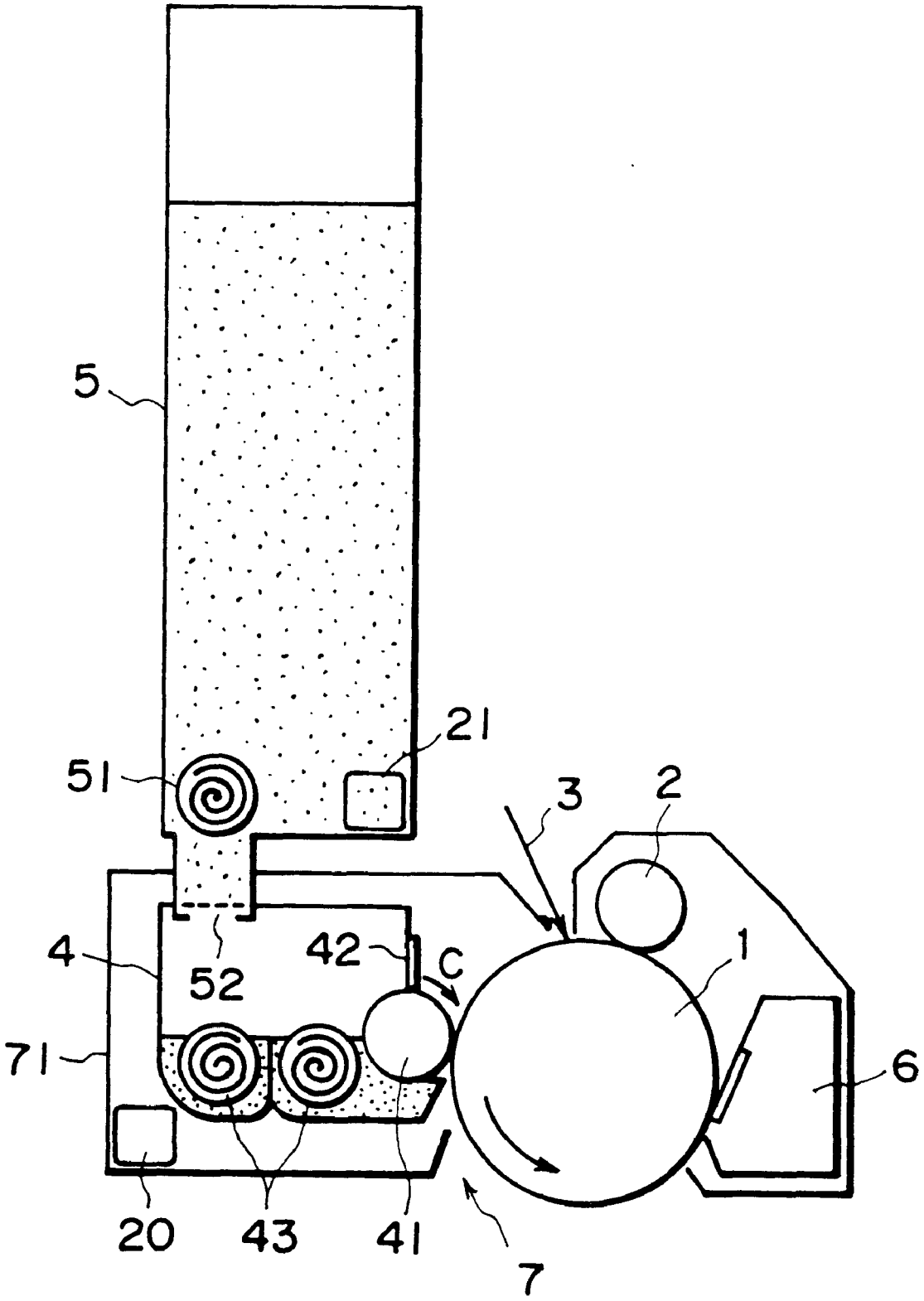
FIG. 1 is an illustration of a process cartridge and a toner supply unit according to the first of 3 embodiments of the present invention.

Referring to FIG. 1, a description will be provided as to a developing device 4 that is the developing means.

The developing device 4 is a 2-component, contact-type developing device (a two-component, magnetic brush developing device) and carries a developer comprising toner and carrier on a developing sleeve 41 enclosing a magnet roller. To the developing sleeve 41, a developer regulating blade 42 is provided with a predetermined gap to form a thin layer of the developer on the developing sleeve 41 with rotation of the developing sleeve 41 in the direction indicated by an arrow C.

The developing sleeve 41 is provided with a predetermined gap from the photosensitive drum 1 such that a thin developer layer formed on the developing sleeve 41 contacts the photosensitive drum 1 in the developing zone.

The toner used in this embodiment is a negative charging toner having an average particle size of 6 $\mu$m, and the carrier is a magnetic carrier having an average particle sides of 35 microns and having a saturation magnetization of 205 emu/$cm^3$. The toner and the carrier are mixed with a weight ratio 6:94 into a developer. In order to maintain a constant toner contact in the developer, the content is detected by an unshown detecting means, and in response to the detection, the toner is supplied from the developer supply unit 5. In the developer supply unit 5, a toner supplying screw 51 (toner supply means) is provided to control the amount of the toner supply on the basis of the number (time period) of rotations.

In the developing device 4, there are provided two stirring screws 43 for electrically charging the toner, which rotate in synchronism with the rotation of the developing sleeve 41 to electrically charge the supplied toner to a predetermined degree.

Referring back to FIG. 2, the yellow image formed on the photosensitive drum 1 enters the primary transfer nip N1 of the intermediary transfer belt 8 in the primary transfer nip NI, and the flexible electrode 9 contacts the back side of the intermediary transfer belt 8. The flexible electrode 9 is connected with a primary transfer bias voltage source 9*a* for application of a bias voltage independently for the respective port.

The intermediary transfer belt 8 receives a yellow image at a first color port, and then receives superposedly the magenta, cyan, black images at the respective ports from the associated photosensitive drum 1.

The 4 color (full-color) image formed on the intermediary transfer belt 8 is then altogether transferred onto the transfer material P supplied with the image by the pair of registration rollers 12, by a secondary transfer roller 10 opposed to the secondary transfer opposing roller 8*c* at the secondary transfer nip N2. Then, it is subjected to a fusing and fixing operation so that a color printed image is provided.

The secondary untransferred toner remaining on the intermediary transfer belt 8 is removed by the blade cleaning of the middle transfer belt cleaner 11 so as to be prepared for the next image-forming operation.

As the material of the intermediary transfer belt 8, an expandable or shrinkable material is not preferable to assure registration of the images at the ports, and therefore, the preferable material is resin or a rubber belt having a metal core.

In this embodiment, carbon dispersed PI (polyimide) having a volume resistivity in the order of $10^8$ Ohm.cm is used. The thickness thereof is 80 $\mu$m, and the length thereof is 320 mm, and the total length of the circumference is 900 mm.

The flexible electrode 9 is made of carbon dispersed high density polyethylene material which can be controlled to have a low resistance and which has a sufficient flexibility and anti-wearing property. The resistance is not more than $10^4$ Ω, and the thickness is 500 $\mu$m. And the length is 315 mm to avoid the leakage to the photosensitive drum 1.

The image forming conditions are as follows:

The dark potential of the photosensitive drum (the potential provided by the primary charging or the potential of the non-image portion) Vd:−600V The light potential (the potential of the image portion or the potential of the portion exposed to the laser beam) Vl:−150V Developing method: 2 component magnetic brush development Developing bias Vdc:−400V, Vac=1800Vpp with frequency of 2300 Hz Process speed: 117 mm/sec Primary transfer bias voltage:

First color: +400V

Second color: +400V

Third color: +400V

Fourth color: +400V

The throughput of the printer with the use of plain paper is 24 ppm with lateral side feeding (216 mm), and the integral between adjacent images (sheet interval) is 80 mm.

In FIG. 1, the process cartridge 7 is in the form of a unit including the photosensitive drum 1, the developing device 4, the charging roller 2 the cleaner 6 and a cover 71 (frame) covering them. The developer supply unit 5 and the process cartridge 7 are inserted and mounted into predetermined positions in the color laser beam printer by the mounting means 60, 70, respectively in a predetermined manner, and are removed therefrom.

The developer supply unit 5 and the process cartridge 7 are provided with a storing means 21 and a storing means 20, respectively, and information on the remaining toner amount in the developer supply unit 5 and the lifetime of the process cartridge 7 can be communicated to the user on the basis of the information on the usage thereof stored in the storing means 20, 21.

The storing means 20, 21 usable with the present invention, may be any memory if it can rewritably store and retain the signal information. Examples include an electrical storing means such as a RAM, a rewritable ROM, a magnetic storing means such as a magnetic memory medium, a magnetic bubble memory, a photo-magnetic memory or the like.

Figure 3:
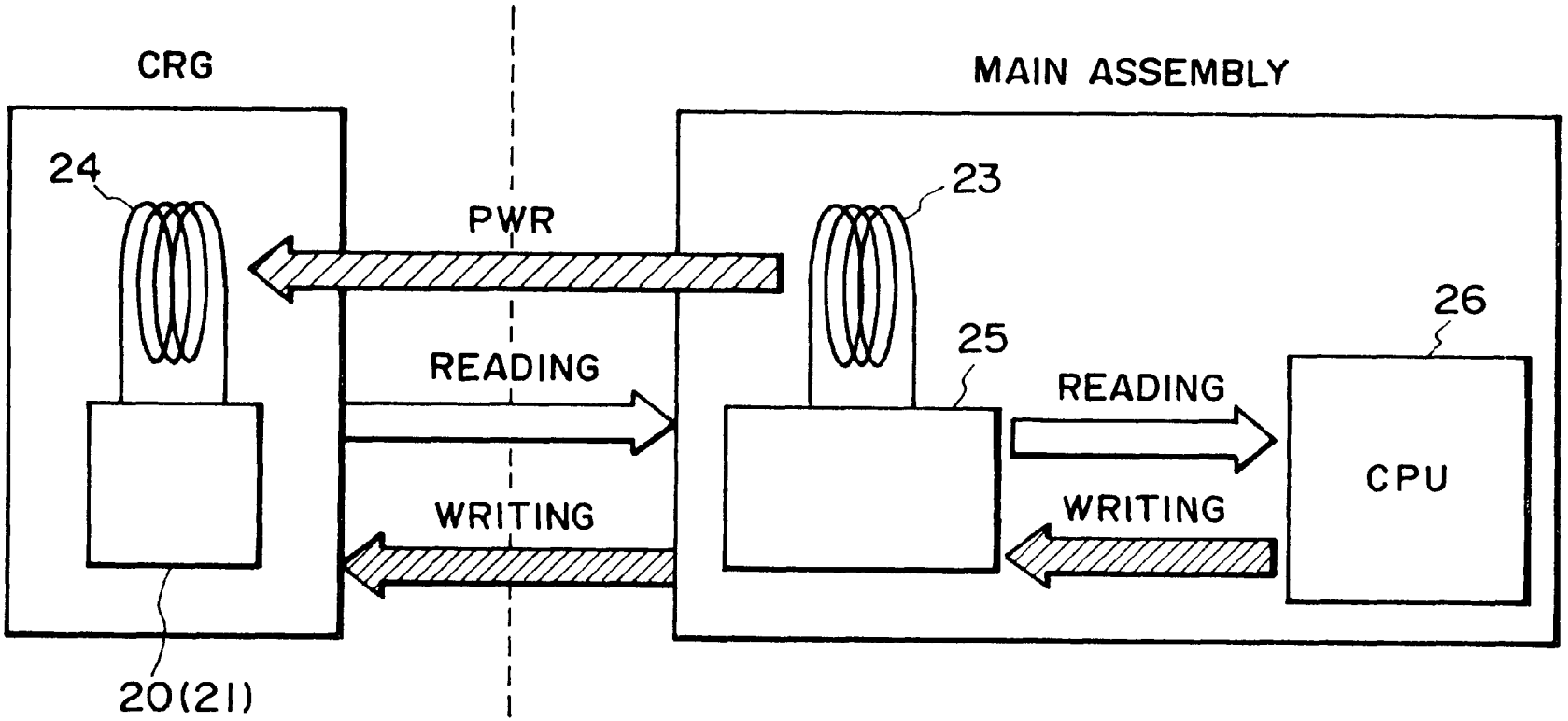
FIG. 3 is an illustration of a structure for communication between the main assembly and the non-contact memory of the process cartridge or the toner supply unit.

Referring to FIG. 3, a description will be provided as to a structure for communication between the storing means 20, 21 and the main assembly in this embodiment.

As shown in FIG. 3, in the main assembly, the antenna 23 and a resonance circuit including an unshown capacitor, an operation voltage source is generated from electromagnetic radiation sent to the antenna 24 in the developer supply unit 5 or process cartridge 7 from the reader-writer 25. The communication is possible without use of a voltage source in the developer supply unit 5 or process cartridge 7.

Each of the developer supply unit 5 and the process cartridge 7 is provided with non-volatile memory 20, 21 as the storing means. In this embodiment, the use is made of a ferroelectric nonvolatile memory (FeRAM) 20, 21 as an example. The data sent from the CPU26 in the main assembly is written in the FeRAM 20, using the reader/writer 25, and the information in the FeRAM is sent out to the main assembly CPU26.

A description will be provided as to the remaining toner amount detecting mechanism for the developer supply unit 5 in this embodiment. It may be any such mechanism if it can detect that the remaining amount of the developer (toner) becomes less than a predetermined level, and may be any known proper ones. More particularly it may detect the electrostatic capacity of the toner, it may detect the weight of the toner, or it may be a light-transmission-type mechanism.

In this embodiment, the detecting means uses a number of rotations of the toner supplying screw 51, which is a developer supply member shown in FIG. 1.

Figure 4:
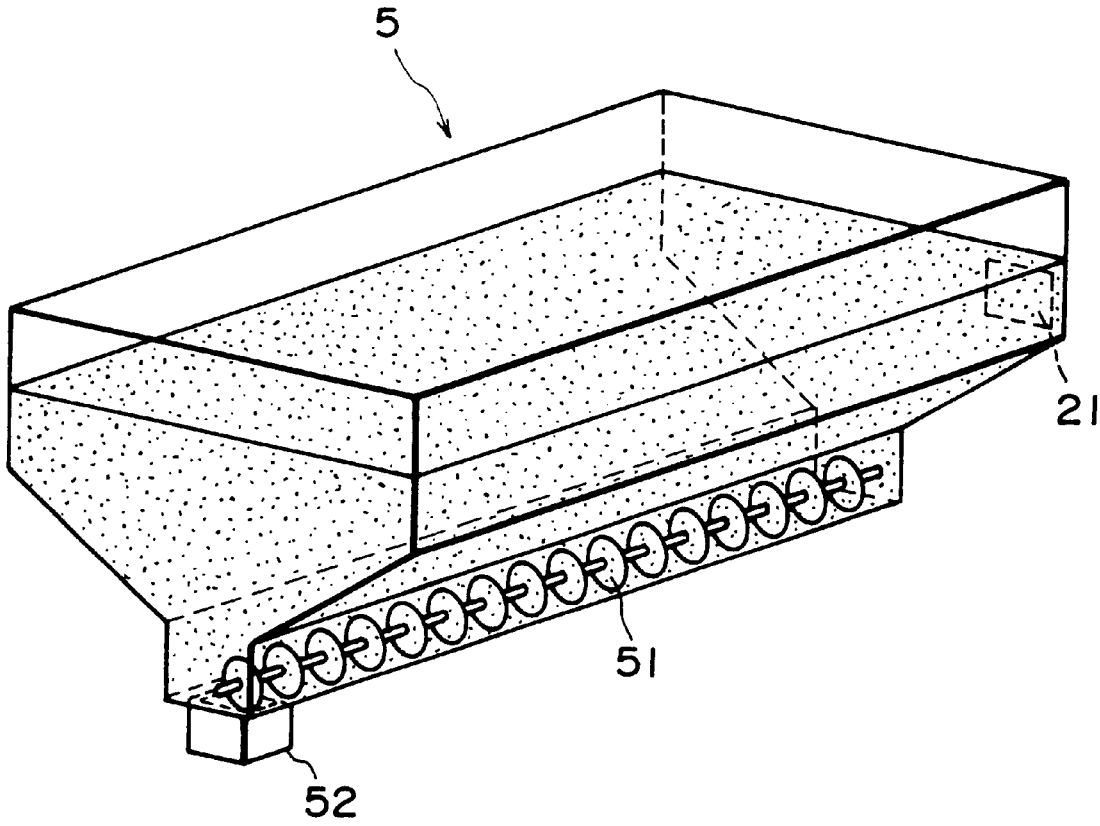
FIG. 4 is a perspective view of a toner supply unit according to the first to third embodiments of the present invention.

FIG. 4 is an enlarged perspective view of the developer supply unit 5, which is a developer supply unit. The supplying screw 51 is rotated by the motor 28 (FIG. 5) for the screw driving which is controlled by the CPU 26 in the main assembly, and the toner is supplied to the process cartridge 7 through the supply opening 52. The developer supply unit 5 used in this embodiment has a capacity of 600 g with which 20,000 images (converted to A4 sheet and printing ratio 5%) can be printed. Normally, the toner supplying screw is controlled to rotate for 1 sec., by which the toner of 300 mg is supplied into the process cartridge 7. Thus, when the toner supplying screw 51 rotates for 2000 sec., the remaining toner amount in the developer supply unit 5 is zero.

Figure 5:
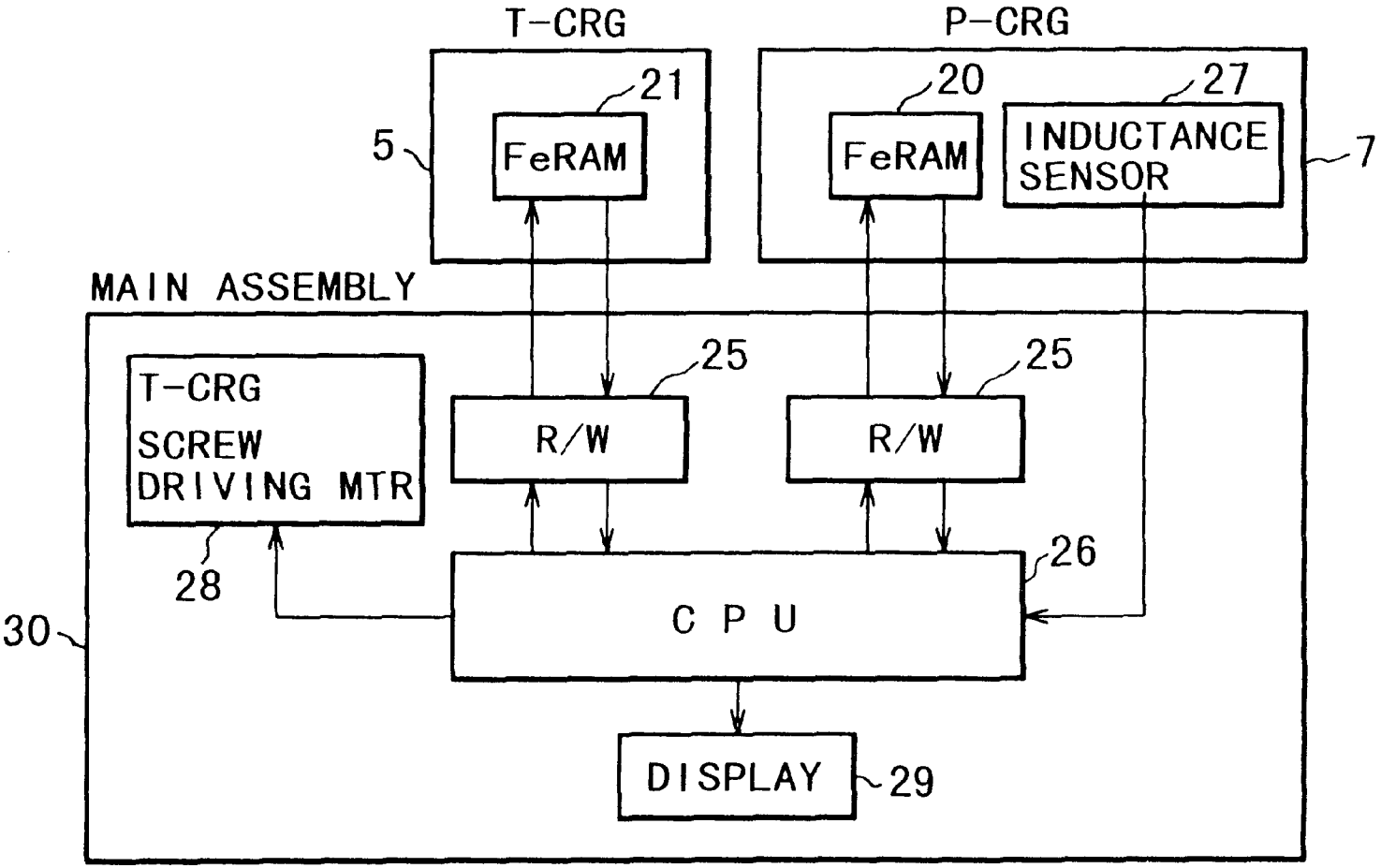
FIG. 5 is a block diagram of a detecting mechanism for remaining toner amount according to the first and second embodiments of the present invention.

FIG. 5 is a block diagram illustrating a remaining toner amount detection and process cartridge lifetime detecting mechanism in the color laser beam printer in this embodiment.

As shown in FIG. 5, the process cartridge 7 is provided with an inductance sensor 27 for detecting the toner content in the 2 component developing device. The inductance sensor 27 exhibits an output voltage which changes with the content ratio of the toner and the magnetic carrier in the mixture thereof, and when the toner content is low, a signal is sent to the CPU 26 so as to supply the toner. The CPU 26, receiving the signal, rotates the screw driving motor 28 for the developer supply unit toner supply, thus supplying the toner from the developer supply unit 5 to the process cartridge 7. At this time, the CPU 26 writes the data indicative of the rotation time period of the screw driving motor 28 in the FeRAM 21 of the developer supply unit 5 using the reader/writer 25 for the developer supply unit 5.

The event that developer supply unit 5 reaches the no-toner state is sent to the CPU 26 as a signal, and the information is written in the FeRAM 20 of the process cartridge 7 by a reader/writer 25 for the process cartridge 7, and the number of the developer supply units 7 used until then is stored.

Therefore, the amount of the remaining toner in the developer supply unit 5 is predicted on the basis of the rotation time of the toner supplying screw 51.

In this embodiment, the setting is as follows. When the rotation time of the screw 51 for the toner supply reaches 1,800 sec. (18,000 image), a toner Low 2 signal is produced; when the rotation time of the screw 51 for the toner supply reaches 1,900 sec. (19,000 image), a toner Low 2 signal is produced; when the rotation time of the screw 51 for the toner supply reaches 2,000 sec. (20,000 image), a no-toner signal is produced. These events are communicated to the user by displaying means 29 from the CPU 26.

For example, in response to the toner Low 1 signal, "further 2,000 images printable (A4, A4 printing ratio 5%)" is displayed to suggest the preparation of the developer supply unit. In response to the toner Low 2 signal, "further 1,000 images printable (A4, A4 printing ratio 5%)" is displayed. When the no-toner signal is produced, "no toner" is displayed to suggest to the user not to run the main assembly. Thus, various and very important information can be given to the user.

A description will be provided as to how to discriminate the remaining life of the process cartridge 7 by writing the no-toner information of the developer supply unit 5 in the FeRAM 20 of the process cartridge 7.

The factors determining the lifetime of the process cartridge 7 include the deterioration of the photosensitive drum 1, the fullness of the residual toner in the cleaner 6, the deterioration of the developer carrier, the contamination of the charging means or the like.

In this embodiment, the cleaner-full detection is taken as a lifetime determining factor of the process cartridge 7 among these factors since it may damage the main assembly, or it may significantly damage the usability.

The detection of the fullness of the cleaner 6 is not possible on the basis of the rotation number of the photosensitive drum 1 alone, and therefore, a sensor for detecting the fullness is normally provided in the cleaner 6. However, the collected toner can be predicted from the toner use amount and the transfer efficiency, so that the fullness detection sensor can be omitted.

In this embodiment, the collected toner capacity of the cleaner 6 is set to correspond to two developer supply units 5 (40,000 image) with the transfer efficiency of the intermediary transfer belt 8 is assumed as being 90%, plus 150 g for residual toner resulting from density control, registration correction or the like. The event that the cleaner of the process cartridge 7 is full is detected in response to the production of the no-toner signal of the developer supply unit 5, two times, so that the end of the service life of the process cartridge 7 is communicated to the user.

The developer supply unit 5 and the process cartridge 7 having the FeRAM21, 20 described in the foregoing were loaded into the color laser beam printer shown in FIG. 2, and 40,000 sheets were processed with the print ratio of 5%. It has been confirmed that toner Low signal was produced at substantially the correct point, and the developer supply unit 5 reached the end. of the service life at about 20,000 sheets. Then, the second developer supply unit 5 was loaded, and the test was continued. It was confirmed that toner Low signal was produced correctly as in the first history, and the no-toner signal was produced for the developer supply unit 5 at about 40,000 sheets. Despite the exchange of the developer supply unit 5, the collection toner-full detection of the process cartridge 7 correctly operates so that the operation of the main assembly was stopped.

Similarly to the foregoing, according to this embodiment, there is provided storing means (FeRAM) in and from which the information is writable and readable, in each of the developer supply unit and the process cartridge, and the user can be notified in substantially real time of the remaining toner amount of the developer supply unit, the remaining life of the process cartridge, and the number of printable pages, which is very convenient to the users.

Embodiment 2

A description will be provided as to a second embodiment. In this embodiment, the lifetime of the consumption part constituting the process cartridge 7 is detected on the basis of the amount of the toner supplied to the process cartridge 5 from the developer supply unit 7.

As described in the description of the first embodiment, the factors determining the lifetime of the process cartridge 7 includes the deterioration of the photosensitive drum 1, the collected toner capacity of the cleaner 6 (fullness detection), the defective cleaning due to the deterioration of the cleaner blade, the deterioration of the developer carrier, and the contamination of the charging means, or the like. Not all of them are integer multiples of the developer supply unit lifetime.

In this embodiment, the data of the toner amount supplied from the developer supply unit 5 to the process cartridge 7 is written not only in the FeRAM21 of the developer supply unit 5 but also in the FeRAM20 of the process cartridge 7, so that lifetime detection of the consumption part can be effected more effectively in real time.

In the first embodiment, the end of the service life of the process cartridge 5 is detected by the two occurrences of the no-toner of the developer supply unit 5. In this embodiment, the cleaner-full detection of the process cartridge 7 is made as follows. The supply toner amount data sent from the developer supply unit 5 is integrated, and when the count reaches 4,000 sec. in the event that the cleaner-full state is assumed to occur, a signal is sent to the CPU 26 to stop the operation of the main assembly.

With this structure, the same advantageous effects as with the first embodiment can be provided.

The present invention is effective to discriminate the end of the service life of the process cartridge due to the deterioration of a consumable item such as the cleaner blade, the developer carrier, the charging roller or the like.

Embodiment 3

Figure 6:
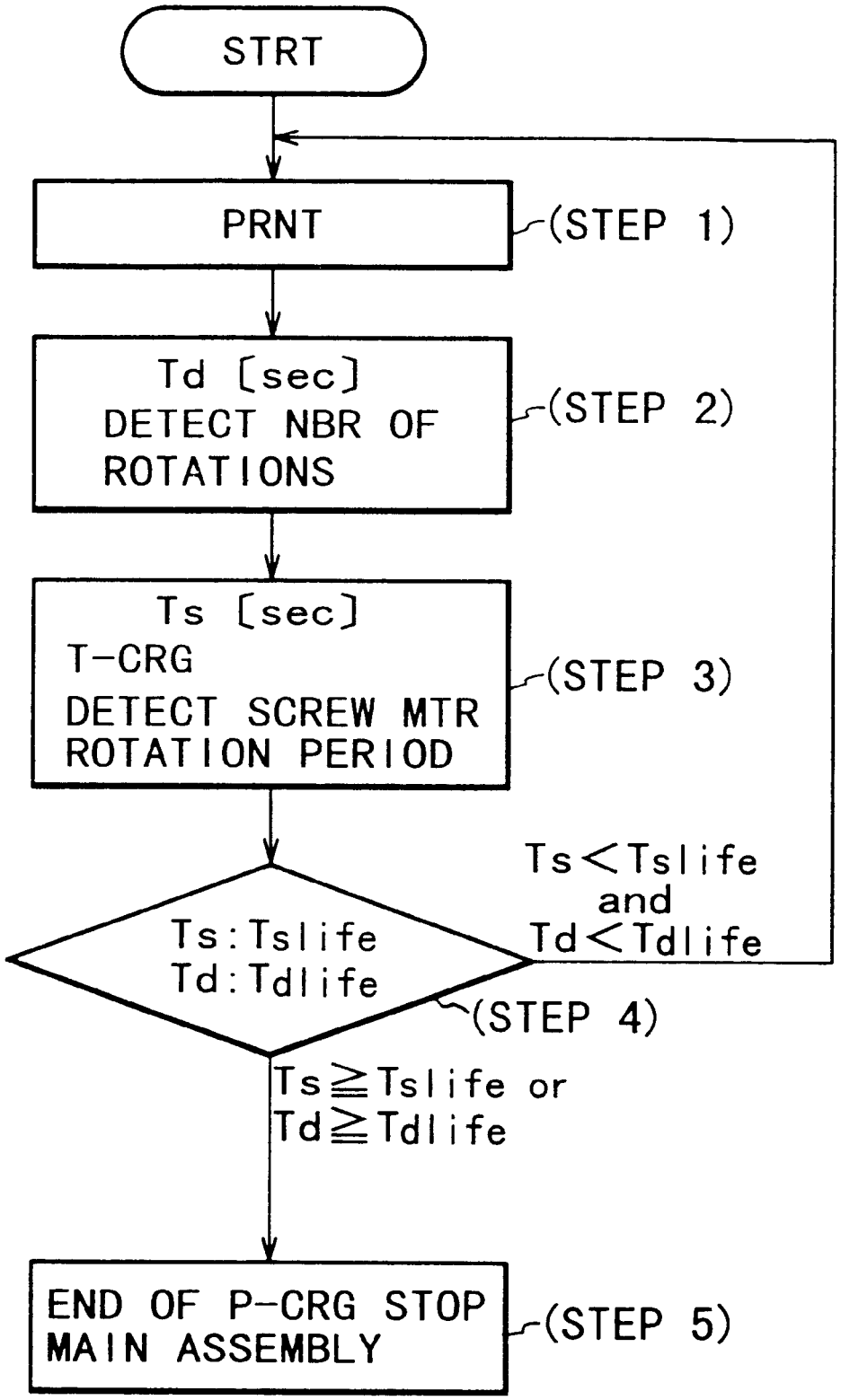
FIG. 6 is a flow chart for the process cartridge lifetime discrimination according to the third embodiment of the present invention.

Referring to FIG. 6 and the foregoing Figures, a description will be provided as to a third embodiment.

In this embodiment, the end of the service life of the process cartridge 7 is detected using the information of a plurality of parameters that influence the service life.

As described in the foregoing, the factors determining the service life of the process cartridge 7 include the deterioration of the photosensitive drum 1, the collected toner capacity of the cleaner 6 (fullness detection), the defective cleaning due to the deterioration of the cleaner blade, the deterioration of the developer carrier, the contamination of the charging means, the like.

The service life of the process cartridge 7 is particularly influenced by the deterioration of the image due to the change of the film thickness of the photosensitive drum 1 and the fullness of the cleaner 6.

When a large amount of prints are produced with a low printing ratio, image deterioration occurs as a result of a reduction in the film thickness of the photosensitive drum 1 prior to using-up of the toner in the developer supply unit 5. When the printing is carried out with a high printing ratio, the fullness of the cleaner 6 occurs prior to the end of the service life of the photosensitive drum 1. Either means the end of the process cartridge 7.

The change of the film thickness of the photosensitive drum 1 is not determined on the basis of the information of the supply toner amount from the developer supply unit 5. In view of this, the number of the rotations of the drum is measured. On the other hand, the fullness detection of the cleaner 6 cannot be achieved on the basis of the number of rotations of the drum alone. A fullness sensor or the prediction operation of second embodiment on the basis of the supply of the toner is required.

In this embodiment, the data of the number of rotations of the photosensitive drum 1 is written in FeRAM20 of the process cartridge 7, and the data are compared with the toner supply data supplied from the FeRAM21 of the developer supply unit 5, so that discrimination is made as to which end of the service life comes first, and on the basis of the discrimination, the end of the service life of the process cartridge 7 is detected.

FIG. 6 is a flow chart of the discrimination of the end of the service life of the process cartridge 7 according to this embodiment.

In FIG. 6, when the printing operation is carried out (step 1), the CPU 26 in the main assembly integrates the time Td of the rotation of the photosensitive drum 1, and the time Td is written in the FeRAM20 in the process cartridge 7. When the toner supply is carried out from the developer supply unit 5 into the developing device 4 of the process cartridge 7, the time Ts of rotation of the screw driving motor for the toner supply, and the time Ts is written in the FeRAM21, 20 of the developer supply unit 5 of the process cartridge 7 (step 3). The CPU 26 always compares the rotation times Td, Ts with the preset lifetime (time) Tdlife and the life (step 4).

When both of the rotation times Td, Ts are shorter than the service life times Tdlife and Tslife, respectively, the operation continues, but when either one of the rotation times Td, Ts exceeds the corresponding service lifetime, the end of the service life of the process cartridge 7 is discriminated, so that the main assembly is stopped, and the exchange of the process cartridge 7 is suggested to the user.

As described in the foregoing, the data relating to the film thickness of the photosensitive drum represented by the data of the number of the rotations architect is written in the FeRAM20 of the process cartridge 7, and both of the data and the toner supply data in the FeRAM21 of the developer supply unit 5 are always compared with the preset data indicative of the service life of the process cartridge 7. The end of the service life of the process cartridge 7 is discriminated by the data of them whichever comes first. In this manner, in the case that the process cartridge 7 contains a plurality of consumable parts, the user can be notified of the remaining toner amount and the printable number of pages in real time, and the service life of the process cartridge 7 to be detected. Such an electrophotographic image forming apparatus, process cartridge 7, developer supply unit 5 and the like can be provided.

While the invention has been described with reference to the structure disclosed herein, it is not confined to the details set forth and this application is intended to cover such modifications or changes as may come within the purposes of the improvements or the scope of the following claims.

What is claimed is:

1. A memory device to be mounted on a process unit of an image forming apparatus, the process unit being usable with a main body of the image forming apparatus, the process unit including an image bearing member, and developing means for developing a latent image formed on the image bearing member, said memory device comprising:

a memory portion for storing information relating to a drive history of a supply member contained in a supply unit which is detachably mountable to the apparatus independently of the process unit, and information relating to a rotation history of the image bearing member.

2. A memory device according to claim 1, wherein the information relating to the drive history of the supply member relates to the amount of toner supplied from the supply unit to the developing means.

3. A memory device according to claim 1, wherein said memory device further stores information relating to the process unit.

4. A memory device according to claim 1, wherein the process unit further includes charging means for electrically charging the image bearing member, cleaning means for cleaning the image bearing member, and a container for accommodating the toner collected from the image bearing member by the cleaning means.

5. A memory device according to claim 1, wherein said memory device is communicable with the main body by electromagnetic waves.

6. A control system for controlling an image forming apparatus including a main body and a process unit, the process unit including an image bearing member and developing means for developing a latent image formed on the image bearing member, said system comprising:

a memory device provided on the process unit and including a memory portion for storing information relating to a drive history of a supply member contained in a supply unit which is detachably mountable to the apparatus independently of the process unit, and information relating to a rotation history of the image bearing member, and discriminating means for discriminating the replacement time of the process unit in accordance with the information relating to the drive history of the supply member and the information relating to the rotation history of the image bearing member, wherein said discriminating means discriminates the replacement time of the process unit when one of the information relating to the drive history of the supply member and the information relating to the rotation history of the image bearing member exceeds a predetermined level which is predetermined for each of the information relating to the drive history of the supply member and the information relating to the rotation history of the image bearing member.

7. A control system according to claim 6, wherein the information relating to the drive history of the supply member relates to the amount of toner supplied from the supply unit to the developing means.

8. A control system according to claim 7, further comprising outputting means for outputting a signal indicative of the event that the information relating to the drive history of supply member and the information relating to the rotation history of the image bearing member reaches the predetermined level which is predetermined for each of the information relating to the drive history of supply member and the information relating to the rotation history of the image bearing member.

9. A control system according to claim 8, further comprising display means for displaying information indicative of the necessity of replacement of the process unit when said outputting means produces the signal.

10. A control system according to claim 6, wherein the information relating to the drive history of the supply member is indicative of the number of used supply units.

11. A control system according to claim 6, wherein said memory portion further stores information relating to the process unit.

12. A control system according to claim 6, further comprising density detecting means for detecting the density of the developer in the developing means, wherein the supply unit is operated in accordance with the density detected by said density detecting means.

13. A control system according to claim 6, wherein the process unit further includes charging means for electrically charging the image bearing member, cleaning means for cleaning the image bearing member, and a container for accommodating the toner collected from the image bearing member by the cleaning means.

14. A control system according to claim 6, wherein the image forming apparatus comprises a plurality of pairs of the process unit and the developer supply unit.

15. A control system according to claim 6, wherein said memory device is communicable with the main body by electromagnetic waves.

16. An image forming apparatus comprising:

a process unit detachably mountable to said apparatus, said process unit including an image bearing member, developing means for developing a latent image formed on said image bearing member, and means for storing information;

a supply unit detachably mountable to said apparatus for supplying a toner to said developing means, said supply unit including a supply member which is driven when the toner is supplied to said developing means, wherein said process unit and said supply unit are independently mountable to and demountable from said apparatus; and discriminating means for discriminating the replacement time of said process unit in accordance with information relating to the drive history of said supply member and information relating to the rotation history of said image bearing member, wherein said discriminating means discriminates the replacement time of said process unit in the case that one of the information relating to the drive history of said supply member and the information relating to the rotation history of said image bearing member reaches a predetermined level which is a predetermined level for each of the information relating to the drive history of said supply member and the information relating to the rotation history of said image bearing member.

17. An image forming apparatus according to claim 16, wherein the information relating to the drive history of said supply member relates to the amount of toner supplied from said supply unit to said developing means.

18. An image forming apparatus according to claim 16, wherein the information relating to the drive history of said supply member is indicative of the number of used supply units.

19. An image forming apparatus according to claim 16, further comprising outputting means for outputting a signal indicative of the event that the information relating to the drive history of said supply member and the information relating to the rotation history of said image bearing member reaches the predetermined level which is predetermined for each of the information relating to the drive history of said supply member and the information relating to the rotation history of said image bearing member.

20. An image forming apparatus according to claim 19, further comprising display means for displaying information indicative of the necessity of replacement of said process unit when said outputting means produces the signal.

21. An image forming apparatus according to claim 16, further comprising a memory portion storing the information relating to the drive history of said supply member and the information relating to the rotation history of said image bearing member, wherein said memory portion further stores information relating to said process unit.

22. An image forming apparatus according to claim 16, further comprising density detecting means for detecting a density of the developer in said developing means, wherein said supply unit is operated in accordance with the density detected by said density detecting means.

23. An image forming apparatus according to claim 16, wherein said process unit further includes charging means for electrically charging said image bearing member, cleaning means for cleaning said image bearing member and a container for accommodating the toner collected from said image bearing member by said cleaning means.

24. An image forming apparatus according to claim 16, wherein said apparatus comprises a plurality of pairs of said process unit and said supply unit.

25. An image forming apparatus according to claim 16, further comprising a memory portion storing the information relating to the drive history of said supply member and the information relating to the rotation history of said image bearing member, and wherein said memory device is communicatable with a main body of said image forming apparatus by electromagnetic waves.

* * * * *

UNITED STATES PATENT AND TRADEMARK OFFICE

CERTIFICATE OF CORRECTION

PATENT NO. : 6,718,144 B2
DATED : April 6, 2004
INVENTOR(S) : Koichi Hiroshima et al.

It is certified that error appears in the above-identified patent and that said Letters Patent is hereby corrected as shown below:

Column 1,
Line 31, “mountably” should read -- mountable --.

Column 3,
Line 14, “tridges” should read -- tridge --.

Column 4,
Line 1, “sides” should read -- size --.

Column 5,
Line 46, “CPU26” should read -- CPU 26 --.
Line 49, “CPU26.” should read -- CPU 26. --.

Column 7,
Line 21, “end.” should read -- end --.
Line 58, “time.” should read -- time. ¶ In this embodiment, the lifetime discrimination made in the first embodiment is replaced with the following. --.

Column 8,
Line 19, “the like.” should read -- or the like. --.

Column 9,
Line 5, “architect” should be deleted.

Signed and Sealed this

Twenty-fourth Day of August, 2004

JON W. DUDAS
*Director of the United States Patent and Trademark Office*